US009620852B2

(12) United States Patent
Tai

(10) Patent No.: US 9,620,852 B2
(45) Date of Patent: Apr. 11, 2017

(54) MULTI-BAND ANTENNA

(71) Applicant: HON HAI PRECISION INDUSTRY CO., LTD., New Taipei (TW)

(72) Inventor: Lung-Sheng Tai, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 528 days.

(21) Appl. No.: 13/971,815

(22) Filed: Aug. 20, 2013

(65) Prior Publication Data

US 2014/0049431 A1 Feb. 20, 2014

(51) Int. Cl.

| | |
|---|---|
| ***H01Q 5/371*** | (2015.01) |
| ***H01Q 1/36*** | (2006.01) |
| ***H01Q 1/24*** | (2006.01) |
| ***H01Q 9/42*** | (2006.01) |
| ***H01Q 13/16*** | (2006.01) |

(52) U.S. Cl.

CPC ..... *H01Q 1/36* (2013.01); *H01Q 1/243* (2013.01); *H01Q 5/371* (2015.01); *H01Q 9/42* (2013.01); *H01Q 13/16* (2013.01)

(58) Field of Classification Search

CPC H01Q 5/00; H01Q 5/30; H01Q 5/307; H01Q 5/321; H01Q 5/328; H01Q 5/364; H01Q 5/378; H01Q 5/385; H01Q 5/392; H01Q 13/103; H01Q 13/106; H01Q 1/243; H01Q 1/36; H01Q 5/371; H01Q 9/42; H01Q 13/16

USPC ..... 343/700 MS

See application file for complete search history.

(56) References Cited

U.S. PATENT DOCUMENTS

| | | | | |
|---|---|---|---|---|
| 7,170,450 | B2 * | 1/2007 | Chang | H01Q 1/243 343/700 MS |
| 7,375,686 | B2 | 5/2008 | Ko | |
| 7,825,863 | B2 * | 11/2010 | Martiskainen | H01Q 1/243 343/700 MS |
| 8,963,780 | B2 * | 2/2015 | Hsu | H01Q 5/378 343/700 MS |
| 8,994,604 | B2 * | 3/2015 | Puente Baliarda | H01Q 1/36 343/803 |

(Continued)

FOREIGN PATENT DOCUMENTS

| | | |
|---|---|---|
| CN | 1761106 A | 4/2006 |
| CN | 201185228 | 1/2009 |

(Continued)

*Primary Examiner* — Dameon E Levi
*Assistant Examiner* — Jennifer F Hu
(74) *Attorney, Agent, or Firm* — Wei Te Chung; Ming Chieh Chang

(57) ABSTRACT

An antenna includes a grounding portion with a grounding feed point, a radiating plane and a coaxial cable. The grounding portion extends in a lengthwise direction defining two ends opposite to each other in the lengthwise direction. The radiating plane extends upwardly from a lengthwise edge of the grounding portion. The radiating plane includes a first arm extending from one end of the lengthwise edge and a second arm extending from the opposite end. The first arm defines a signal feed point and a first radiating portion while the second arm is defined as a second radiating portion. The coaxial cable includes a core linking to the signal feed point and a shielding layer linking to the grounding feed point. The second arm surrounds the first arm in the radiating plane.

4 Claims, 3 Drawing Sheets

(56) References Cited

U.S. PATENT DOCUMENTS

| | | | | |
|---|---|---|---|---|
| 2003/0160728 | A1* | 8/2003 | Fukushima | H01Q 1/242<br>343/702 |
| 2004/0046697 | A1* | 3/2004 | Tai | H01Q 1/243<br>343/700 MS |
| 2004/0090374 | A1* | 5/2004 | Kuo Dai | H01Q 9/0421<br>343/700 MS |
| 2008/0180333 | A1* | 7/2008 | Martiskainen | H01Q 1/243<br>343/722 |

FOREIGN PATENT DOCUMENTS

| | | | |
|---|---|---|---|
| CN | 102136624 | | 7/2011 |
| TW | M321153 | | 10/2007 |
| TW | M343257 | | 10/2008 |
| TW | 200845490 | A | 11/2008 |
| TW | M321153 | | 10/2010 |
| TW | I346418 | B1 | 8/2011 |

* cited by examiner

MULTI-BAND ANTENNA

BACKGROUND OF THE INVENTION

1. Field of the Invention

The present disclosure relates to a multi-band antenna, and more particularly to a multi-band planar inverted-F antenna.

2. Description of Related Art

Miniaturization is a trend for portable electronic devices. Thus, components inner the portable electronic devices become thinner and smaller. Antenna, a necessary component in wireless communicating device, is manufactured to be smaller and lower. And the space between the antenna and other components become smaller and smaller. Planar Inverted-F Antenna (PIFA) is a type of often-used antenna inner electronic devices. A typical PIFA always comprises a feed point and two radiating portions extending apart from each other from the feed point for working at different frequency bands. However, as the space between the PIFA and the other components is very small, the other components have negative impacts on the antenna, so that the antenna has a bad performance and fails to cover a broader band.

In view of the above, an improved antenna is desired to overcome the problems mentioned above.

SUMMARY OF THE INVENTION

Accordingly, an object of the present disclosure is to provide an antenna which is capable of covering a broader band.

According to one aspect of the present disclosure, an antenna comprising a grounding portion with a grounding feed point, a radiating plane and a coaxial cable is provided. The grounding portion extends in a lengthwise direction defining two ends opposite to each other in the lengthwise direction. The radiating plane extends upwardly from a lengthwise edge of the grounding portion. The radiating plane comprises a first arm extending from one end of the lengthwise edge and a second arm extending from the opposite end. The first arm defines a signal feed point and a first radiating portion while the second arm is defined as a second radiating portion. The coaxial cable comprises a core linking to the signal feed point and a shielding layer linking to the grounding feed point. The second arm surrounds the first arm in the radiating plane.

Other objects, advantages and novel features of the disclosure will become more apparent from the following detailed description when taken in conjunction with the accompanying drawings, in which:

DETAILED DESCRIPTION OF THE INVENTION

Reference will now be made to the drawings to describe a preferred embodiment of the present disclosure in detail.

Figure 1:
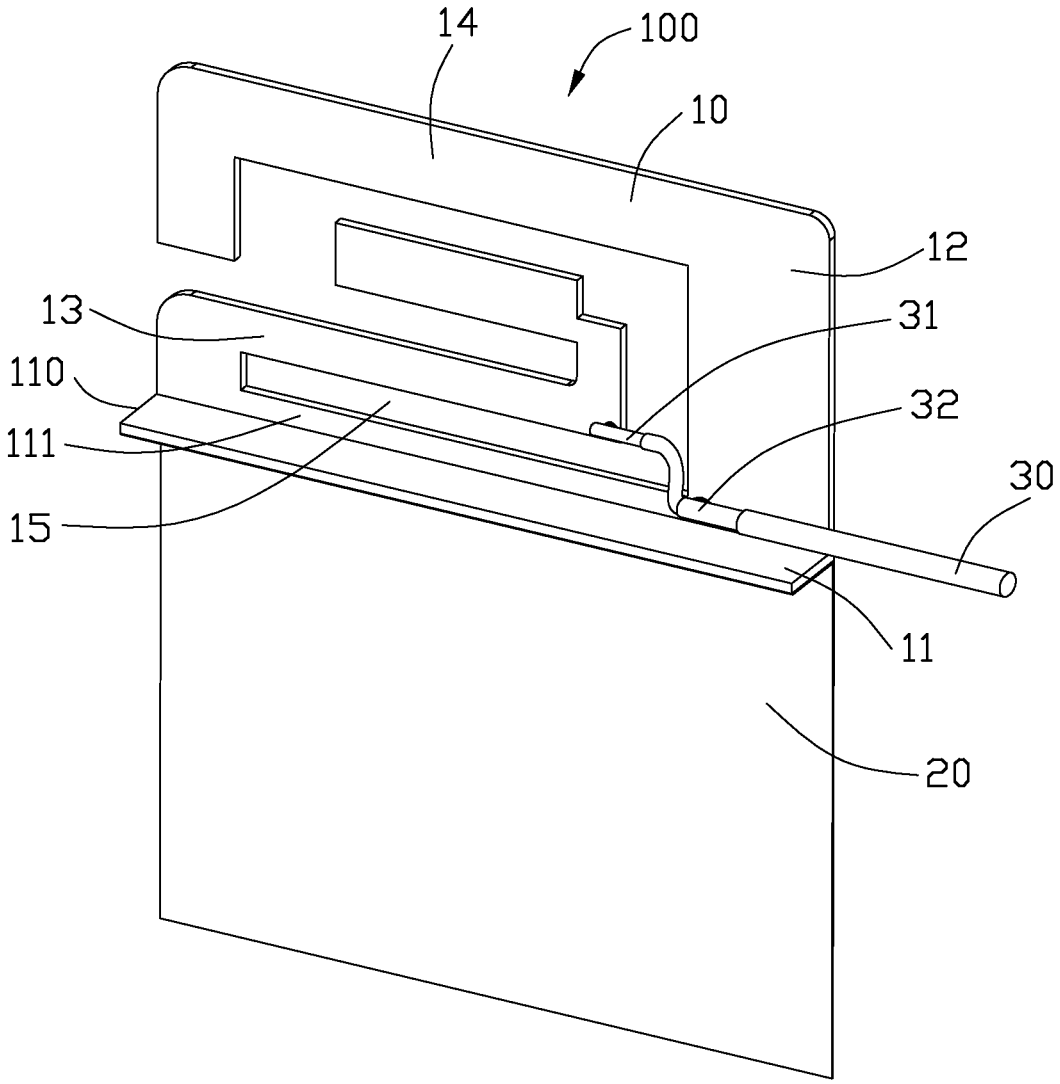
FIG. 1 is a perspective view of an antenna in accordance with a preferred embodiment of the present disclosure.
Figure 2:
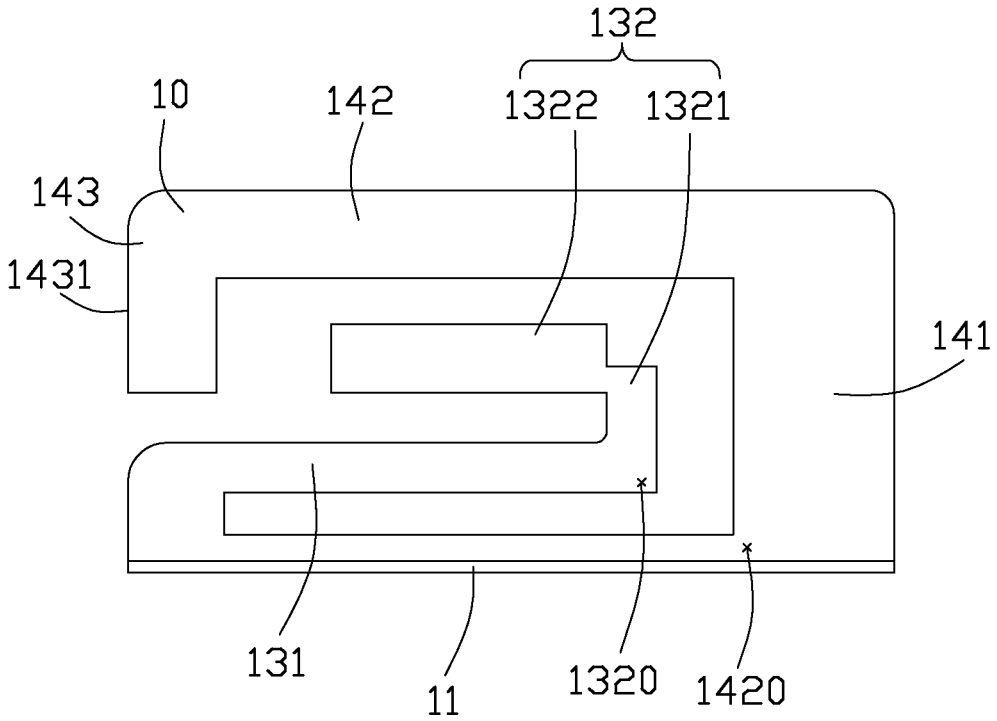
FIG. 2 is a front view of the antenna shown in FIG. 1.

Referring to FIG. 1 and FIG. 2, an antenna 100 in accordance with the preferred embodiment of the present disclosure, comprises a main body 10, a metal foil 20 and a coaxial cable 30. The main body 10 comprises a grounding portion 11 extending in a lengthwise direction in a horizontal plane and a radiating plane 12 extending from a lengthwise edge of the grounding portion 11 and perpendicular to the horizontal plane. The metal foil 20 is pasted on a bottom surface of the grounding portion 11 for strengthening the effect of grounding. The coaxial cable 30 comprises a core 31 and a shielding layer 32 surrounding the core 31. The core 31 is soldered at a signal feed point while the shielding layer 32 is soldered at a grounding feed point.

The grounding portion 11 comprises a first end 110 and a second end opposite to the first end 110 in the lengthwise direction. The radiating plane 12 comprises a first arm 13 extending from the first end 110 of the grounding portion 11 and a second arm 14 extending from the second end of the grounding portion 11. The first arm 13 comprises a connecting portion 131 and a first radiating portion 132. The connecting portion 131 extends from the grounding portion 11 upwardly and then towards the second end in the lengthwise direction and parallel to the grounding portion 11. The first radiating portion 132 extends from an end portion of the connecting portion 131 upwardly and then towards the opposite direction of the connecting portion 131. The first radiating portion 132 is L shaped comprising a first section 1321 connecting with the end portion of the connecting portion 131 and a second section 1322. The second section 1322 is parallel to the connecting portion 131. The core 31 is soldered on a joint of the first radiating portion 132 and the connecting portion 131 to form the signal feed point 1320. The signals flow along the first radiating portion 132 from the signal feed point 1320. The first radiating portion 132 works on a higher frequency band; the frequency band is 5.15-5.85 GHZ.

The shielding layer 32 is soldered on a joint of the grounding portion 11 and the second arm 14 to form the grounding feed point 1420. The second arm 14 serves as the second radiating portion and successively comprises a first section 141, a second section 142 and a third section 143. The first and third sections 141, 143 are parallel to the first section 1321 of the first radiating portion 132. The second section 142 connects the first and third sections 141, 143 and is parallel to the second section 1322 of the first radiating portion 132. The three sections of the second radiating portion 14 form a U shape and surround the first radiating portion 132. The grounding portion 11 together with the second arm 14 forms an outer circle, while the first radiating portion 132 and the connecting portion 131 locate within the outer circle. In the lengthwise direction, the free end of the third section 143 keeps aligned with the free end of the first radiating portion 132 while in the transverse direction perpendicular the lengthwise direction, the third section 143 keeps aligned with the connecting portion 131 and the grounding portion 11. The second radiating portion 14 works on a lower frequency band by coupled by the first radiating portion 132. The frequency band is 2.4-2.5 GHZ.

In the preferred embodiment in accordance with the present disclosure, the grounding portion 11 further comprises a secondary portion 111. The secondary portion 111 extends upwardly from the lengthwise edge of the grounding portion 11. A matching slot 15 is formed between the connecting portion 131 and the secondary portion 111.

Figure 3:
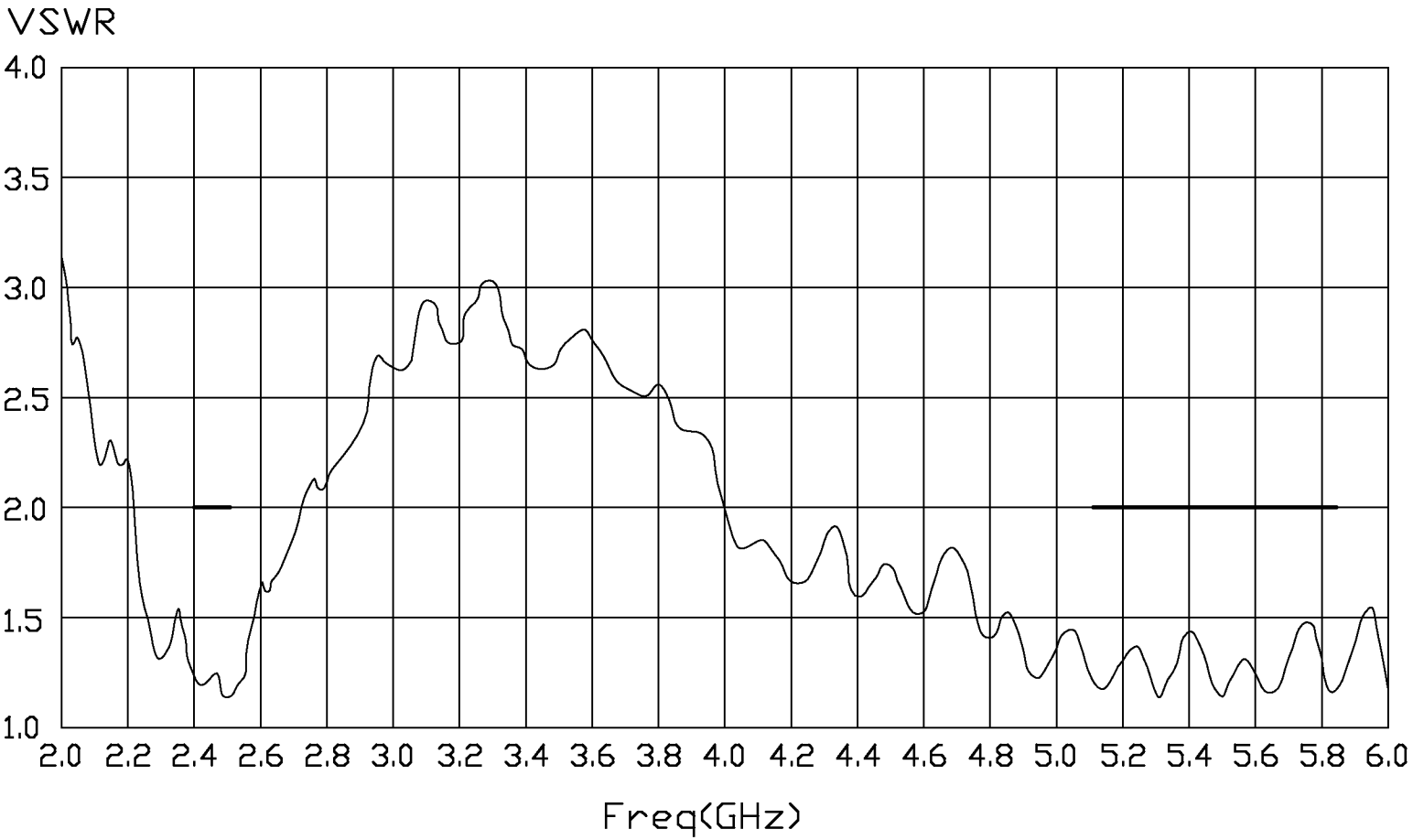
FIG. 3 is a graph showing a voltage standing wave ratio (VSWR) of the antenna of FIG. 1.

The embodiment of the present disclosure comprises the first arm 13 and the second arm 14 surrounding the first arm 13. The first arm 13 comprises the first radiating portion 132 while the second arm 14 is defined as the second radiating portion. The second radiating portion 14 surrounds the first radiating portion 132 so that the first radiating portion 132 works on a higher frequency band while the second radiating portion 14 works on a lower frequency band by coupled by the first radiating portion 132. FIG. 3 shows a graph of a voltage standing wave ratio (VSWR) of the antenna. The antenna can work on 2.4-2.5 and 5.15-5.85 GHZ.

While preferred embodiment in accordance with the present disclosure has been shown and described, equivalent modifications and changes known to persons skilled in the art according to the spirit of the present disclosure are considered within the scope of the present disclosure as defined in the appended claims.

What is claimed is:

1. A multi-band antenna comprising:

a grounding portion defining a grounding feed point;

a first radiating portion;

a connecting portion connecting the grounding portion and the first radiating portion, and defining a matching slot with the grounding portion; and a second radiating portion extending from the grounding portion; wherein the grounding portion together with the second radiating portion defines an outer circle, the first radiating portion locates within the outer circle; wherein the grounding portion extends in a lengthwise direction and defines two ends opposite to each other in the lengthwise direction, and wherein the connecting portion and the first radiating portion extends from one end of the grounding portion while the second radiating portion extends from the other end; wherein in the lengthwise direction, a free end of the second radiating portion keeps aligned with a free end of the first radiating portion while in the transverse direction perpendicular the lengthwise direction, the free end of the second radiating portion keeps aligned with an outermost end of the connecting portion.

2. The multi-band antenna as claimed in claim 1, wherein the first radiating portion successively comprises a first section perpendicular to the connecting portion and a second section parallel to the connecting portion, while the second radiating portion successively comprises a first section, a second section and a third section defining a U shape.

3. The multi-band antenna as claimed in claim 1, wherein the antenna comprises a signal feed point defined on a joint of the first radiating portion and the connecting portion, while the grounding feed point is defined on a joint of the grounding portion and the second radiating portion.

4. The multi-band antenna as claimed in claim 3, wherein the matching slot is U shaped defining an opening, the signal feed point and the grounding feed point are defined at two opposite ends of the opening.

* * * * *